US006662769B2

(12) United States Patent
Eguchi et al.

(10) Patent No.: US 6,662,769 B2
(45) Date of Patent: Dec. 16, 2003

(54) VALVE TIMING CONTROL DEVICE

(75) Inventors: Katsuhiko Eguchi, Kariya (JP); Kazumi Ogawa, Toyota (JP); Masaki Kobayashi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/102,938

(22) Filed: Mar. 22, 2002

(65) Prior Publication Data

US 2002/0152977 A1 Oct. 24, 2002

(30) Foreign Application Priority Data

Mar. 22, 2001 (JP) ..... 2001-083373

(51) Int. Cl.[7] ..... F01L 1/34

(52) U.S. Cl. ..... 123/90.17; 123/90.15; 123/90.16; 123/90.18

(58) Field of Search ..... 123/90.15, 90.16, 123/90.17, 90.18

(56) References Cited

U.S. PATENT DOCUMENTS 5,178,106 A * 1/1993 Suga ..... 123/90.17
5,622,144 A * 4/1997 Nakamura et al. ..... 123/90.15
5,829,398 A * 11/1998 Strauss et al. ..... 123/90.17
6,311,654 B1 * 11/2001 Ushida et al. ..... 123/90.17
6,412,463 B1 * 7/2002 Kinugawa ..... 123/90.17

FOREIGN PATENT DOCUMENTS

JP 10-30411 A 2/1998
JP 11-223112 A 8/1999
JP 2000-97006 A 4/2000

* cited by examiner

*Primary Examiner*—Thomas Denion
*Assistant Examiner*—Ching Chang
(74) *Attorney, Agent, or Firm*—Burns, Doane, Swecker & Mathis, LLP

(57) ABSTRACT

A valve timing control device includes a rotary member rotatably arranged in a torque transmitting route between a crankshaft and a camshaft of an internal combustion engine, a rotational transmitting member rotatable relative to the rotary member, a pressure chamber formed by the rotary member and the rotational transmitting member, a vane provided on the rotary member or the rotational transmitting member to divide the pressure chamber between an advancing chamber and a delaying chamber, a helical spring having a coil portion, a first end portion engaging the rotary member, and a second end portion engaging the rotational transmitting member to urge the rotary member in the advancing direction to expand the advancing chamber. One of the end portions of the helical spring extends on an imagined radial plane arranged in the radial direction of the coil portion.

19 Claims, 10 Drawing Sheets

VALVE TIMING CONTROL DEVICE

This application is based on and claims priority under 35 U.S.C. §119 with respect to a Japanese Patent Application 2001-083373 filed on Mar. 22, 2001, the entire disclosure of which is incorporated herein by reference.

FIELD OF THE INVENTION

The present invention generally relates to a valve timing control device. More particularly, the present invention pertains to a valve timing control device for controlling the angular phase difference between a crankshaft of a combustion engine and a camshaft of the combustion engine.

BACKGROUND OF THE INVENTION

A known valve timing control device includes a rotary member which is rotatably arranged in a torque transmitting route between a crankshaft of an internal combustion engine and a camshaft of the engine, a rotational transmitting member which rotates relative to the rotary member, a pressure chamber formed by the rotary member and the rotational transmitting member, a vane provided on the rotary member or the rotational transmitting member to divide the pressure chamber into an advancing chamber and a retarding chamber, and a helical spring having a coil portion. A first end portion of the spring engages the rotary member and a second end portion engages the rotational transmitting member, with the spring urging the rotary member in the advancing direction to expand the advancing chamber. A controlling device supplies and discharges fluid to and from the advancing chamber and the retarding chamber to control phase alterations between the rotary member and the rotational transmitting member. An example of a known variable timing device having a construction similar to that described above is disclosed in Japanese Patent Laid-Open Publication No. Heisei 11(1999)-223112.

As a plurality of cams arranged on the camshaft push the valves of the internal combustion engine during engine operation, the rotary member always receives some force. The force rotates the rotational transmitting member in the delayed or retarding direction. The above-described known valve timing control device is provided with the helical spring to rotate the rotary member in the advancing direction so that the helical spring offsets this force. Thus, the response in the advancing direction of the rotary member is improved.

However, as shown in FIGS. 17(*a*) and 17(*b*), the structure of the helical spring 270 used in the known valve timing control device includes a coil portion 270*a*, a first hook portion 270*b* and a second hook portion 270*c*. The hook portion 270*b* engages either the rotary member or the rotational transmitting member while the hook portion 270*c* engages the other of the rotary member and the rotational transmitting member. Both of the hook portions 270*b*, 270*c* extend in the axial direction of the coil portion 270*a*. Thus, the total length (LB) of the helical spring 270 is relatively long. Therefore, the overall axial length of the known valve timing control device must be rather long.

SUMMARY OF THE INVENTION

According to one aspect, a valve timing control device includes a rotary member adapted to be rotatably arranged in a torque transmitting route between a crankshaft of an internal combustion engine and a camshaft of the internal combustion engine, a rotational transmitting member rotatable relative to the rotary member, a pressure chamber formed by the rotary member and the rotational transmitting member, a vane provided on the rotary member or the rotational transmitting member dividing the pressure chamber into an advancing chamber and a delaying chamber, and a helical spring which urges the rotary member in the advancing direction to expand the advancing chamber. The helical spring includes a coil portion, a first end portion engaging the rotary member and a second end portion engaging the rotational transmitting member. At least one of the first and second end portions of the helical spring extends on an imagined radial plane arranged in a radial direction of the coil portion.

According to another aspect, a valve timing control device includes a rotary member adapted to be rotatably arranged in a torque transmitting route between a crankshaft of an internal combustion engine and a camshaft of the internal combustion engine, a first annular spring space formed in the rotary member and having an inner circumferential wall and an outer circumferential wall, a rotational transmitting member rotatable relative to the rotary member, a second annular spring space formed in the rotational transmitting member and having an inner circumferential wall and an outer circumferential wall, a pressure chamber formed by the rotary member and the rotational transmitting member, a vane provided on the rotary member or the rotational transmitting member dividing the pressure chamber into an advancing chamber and a delaying chamber, and a helical spring positioned in the first and second annular spring spaces to urge the rotary member in the advancing direction to expand the advancing chamber. The helical spring includes a coil portion, a first end portion and a second end portion, with the first end portion engaging a first groove formed in one of the inner circumferential wall of the rotary member and the outer circumferential wall of the rotary member, and the second end portion engaging a second groove formed in one of the inner circumferential wall of the rotational transmitting member and the outer circumferential wall of the rotational transmitting member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

FIG. 1(*a*) is a vertical cross-sectional view of a first embodiment of a valve timing control device in accordance with the prevent invention.

FIGS. 1(*b*) and 1(*c*) are enlarged cross-sectional views of a part of FIG. 1(*a*).

FIG. 17(*b*) is an end view of the helical spring shown in FIG. 17(*a*).

DETAILED DESCRIPTION OF THE INVENTION

Figures 1A, 1B, 1C:
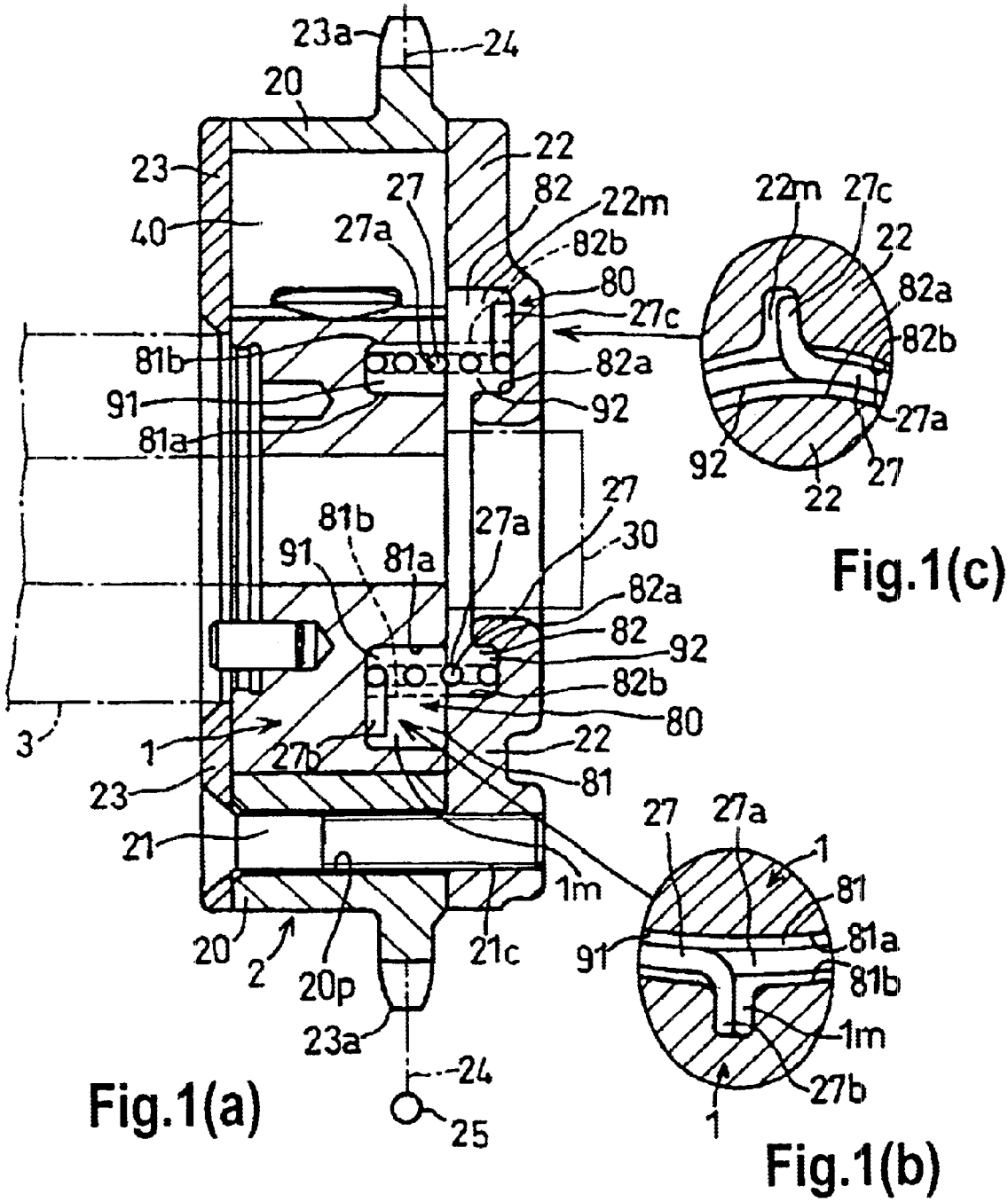

A first embodiment of a valve timing control device is shown in FIGS. 1–5 and is applied to an internal combustion engine for vehicles. As shown in FIG. 1, the valve timing control device has a rotary member 1 and a rotational transmitting member 2. The rotary member 1 is arranged in a torque transmitting route between a crankshaft of the internal combustion engine and a camshaft 3. The rotary member 1 is fixed to the top or end of the camshaft by way of a bolt 30 so that the rotary member 1 rotates together with the camshaft 3. The rotational transmitting member 2 rotates relative to the rotary member 1.

Figure 4:
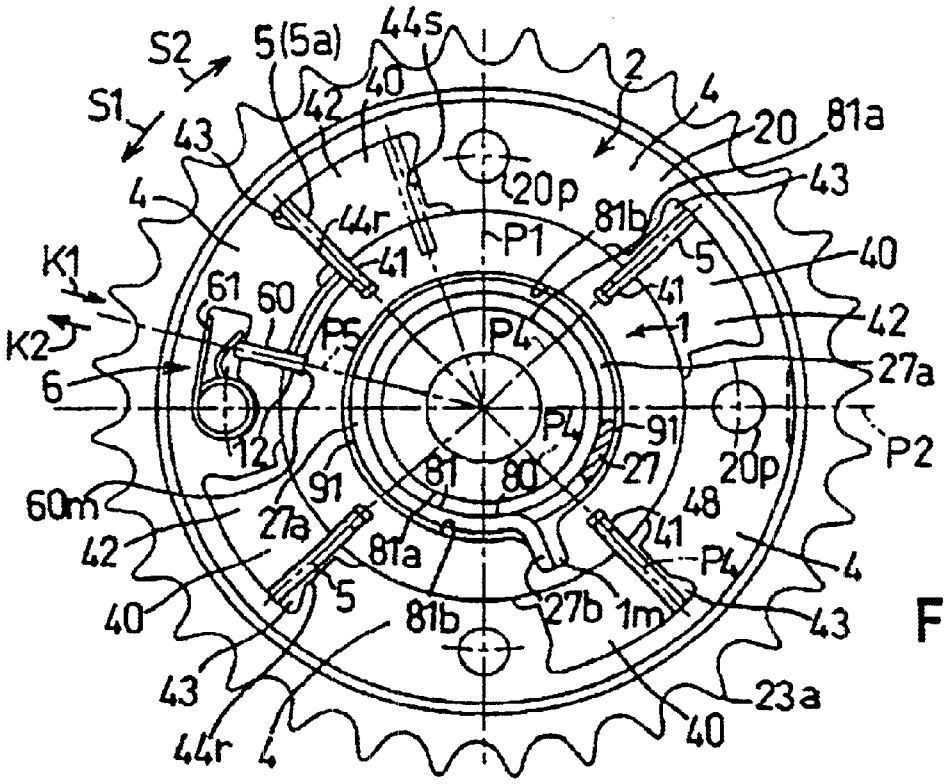
FIG. 4 is a sectional view of the valve timing control device when the rotary member is in the most retarded or delayed position relative to the rotational transmitting member.
Figure 5:
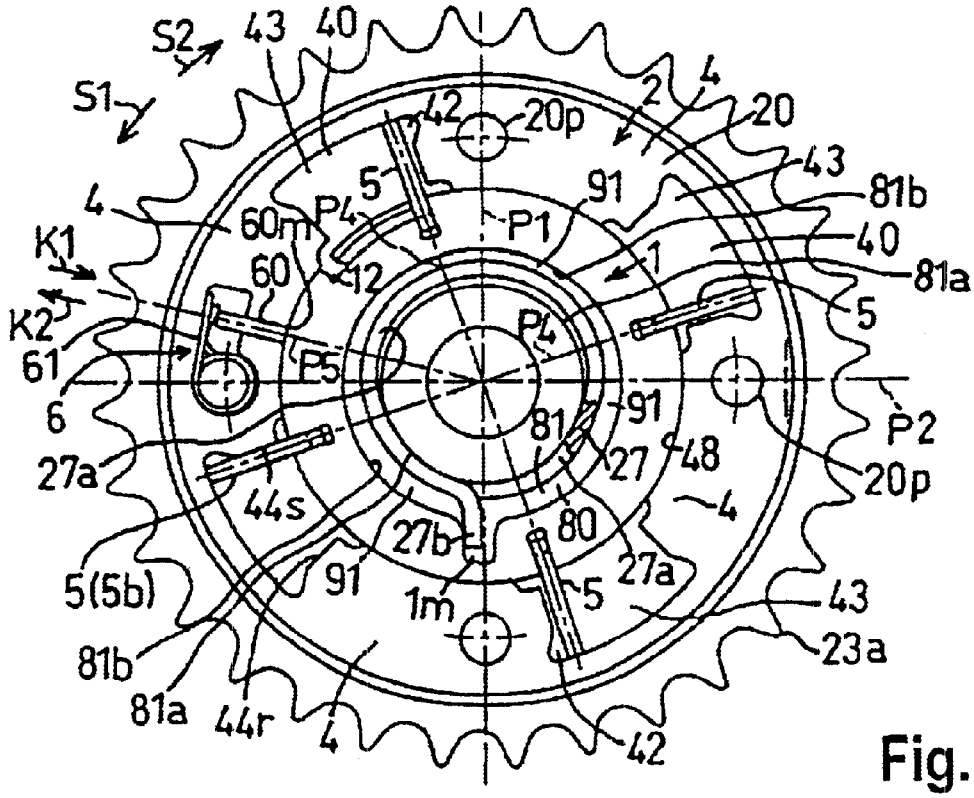
FIG. 5 is a sectional view of the of the valve timing control device when the rotary member is in the most advanced position relative to the rotational transmitting member.

The rotational transmitting member 2 includes a housing 20, a first plate 22 and a second plate 23. The housing 20 is arranged around the rotary member 1 and has four bores 20*p* for receiving fixing bolts 21 as shown in FIGS. 4 and 5. The axial center of the housing 20 is coincident with the axial center of the rotary member 1. The first plate 22 serves as a front plate and is arranged on one surface of the housing 20, and the second plate 23 serves as a rear plate and is arranged on the other surface of the housing 20. Each of the fixing bolts 21 has a screw portion 21*c* to fix the housing 20, the first plate 22 and the second plate 23 together.

The outer surface of the housing 20 is provided with a timing sprocket 23*a* to connect with a gear 25 of the crankshaft via a transmitting means 24, for example a timing chain or a timing belt. When the gear 25 of the crankshaft of the internal combustion engine rotates, the housing 20 with the first and second plates 22, 23 rotates via the transmitting means 24 and the timing sprocket 23*a*. At that time, the housing 20 causes the rotary member 1 with the camshaft 3 to rotate so that the camshaft 3 pushes down the valves of the internal combustion engine so as to open the valves.

As shown in FIG. 4, the housing 20 has four projections 4, each of which extends toward the center of the housing 20. A sliding surface 48 is formed on the tip of the projections 4 to slide around or along the circumference of the rotary member 1. Each projection 4 has circumferentially spaced end portions 44*s*, 44*r*. A pressure chamber 40 is defined by each of the openings between the projections 44*s*, 44*r*. Thus, in this embodiment, there are four pressure chambers 40 which are distributed in the circumferential direction of the housing 20. Each pressure chamber 40 is encircled or surrounded by the outer circumference of the rotary member 1, the housing 20, the first plate 22 and the second plate 23.

Distributed circumferentially about the housing 20 are four vane grooves 41, each of which faces toward the pressure chamber 40 and receives a vane 5. The vanes 5 are arranged on imaginary lines P4 passing through the axial center of the rotary member 1 and arranged so that adjacent ones are at right angles to each other. Each vane 5 divides the respective pressure chamber 40 into a delaying or retarding chamber 42 and an advancing chamber 43. The delaying chambers 42 are connected with pressure passages. The advancing chambers 43 are connected with other pressure passages. The pressure passages are located in the rotary member 1.

One of the projections 4 has a locking mechanism 6. The locking member 6 prohibits the rotary member 1 from rotating in the advanced direction relative to the rotational transmitting member 2 when the rotary member 1 is the most delayed or retarded position. The locking mechanism 6 is comprised of a locking body 60 and a spring 61 for urging the locking body 60 toward the axial center of the rotary member 1 (i.e., the direction indicated by the arrow K1 in FIG. 4). Here, the locking body 60 is arranged on an imaginary line P5 passing through the axial center of the rotary member 1.

When the internal combustion engine is stopped, the rotary member 1 rotates in the delayed direction (i.e., the direction indicated by the arrow S1 in FIG. 4) and reaches the most delayed position shown in FIG. 4. Only the vane 5*a* of the plural vanes 5 contacts the end portion 44*r* of the projection 4. Thus, the contact between the vane 5*a* and the end portion 44*r* is as a stopper for preventing the rotary member 1 from further rotating in the delayed direction relative to the rotational transmitting member 2. When the rotary member 1 is in the most delayed or retarded position, the locking body 60 of the locking mechanism 6 moves into a locking bore 12 of the rotary member 1 by the urging force of the spring 61 so that the rotary member 1 can not rotate in any direction. This condition is desirable for starting the internal combustion engine. As the fluid pressure is not stable at the starting of the internal combustion engine, the locking mechanism 6 maintains the rotational phase between the rotary member 1 and the rotational transmitting member 2.

After a short period has passed from the starting of the internal combustion engine, the fluid pressure becomes stable. The fluid pressure moves to the top or end of the locking body 60 via a fluid pressure passage formed in the rotary member 1. The fluid pressure pushes the end or top of the locking body 60 in order to move the locking body 60 in the K2 direction of FIG. 5. Thus, the locking mechanism 6 is released so that the rotary member 1 rotates relative to the rotational transmitting member 2. Therefore, the rotational phase of the camshaft 3 can rotate relative to that of the crankshaft of the internal combustion engine in the S1 or S2 direction of FIGS. 4 and 5.

When the fluid pressure in the advanced chamber 43 is discharged via an advancing fluid supplying passage and the fluid pressure is supplied into the delayed chamber 42 via a delaying fluid supplying passage, the rotary member 1 with the vanes 5 rotates in the delayed or retarded direction (i.e., the S1 direction of FIGS. 4 and 5) relative to the housing 20.

On the other hand, when the fluid pressure in the delayed chamber 42 is discharged via the delaying fluid supplying passage and the fluid pressure is supplied into the advanced chamber 43 via the advancing fluid supplying passage, the rotary member 1 with the vanes 5 rotates in the advanced direction (i.e., the S2 direction of FIGS. 4 and 5) relative to the housing 20.

FIG. 5 illustrates the most advancing condition where the rotary member 1 with the vanes 5 is furthest rotated relative to the housing 20. As shown in FIG. 5, one vane 5*b* of the plural vanes 5 contacts the end portion 44*s* of one of the projections 4. Thus, the contact between the vane 5*b* and the end portion 44*s* serves as another stopper for preventing the rotary member 1 from rotating further in the advanced direction relative to the rotational transmitting member 2.

The term "the delayed direction" means that the opening and closing timing of the valves of the internal combustion engine is late while the term "the advanced direction" means that the opening and closing timing of the valves of the internal combustion engine is early. When the rotary member 1 with the vanes 5 rotates in the delayed direction, the capacity of the delayed chamber 42 increases and that of the advanced chamber 43 decreases. When the rotary member 1 with the vanes 5 rotates in the advanced direction, the capacity of the delayed chamber 42 decreases and that of the advanced chamber 43 increases. Therefore, the timing valve control device controls the opening and closing timing of the valves so as to control the engine performance.

As shown in FIG. 1, a spring space 80, which is ring-shaped or annular, is arranged between the first plate 22 of the rotational transmitting member 2 and the rotary member 1. The spring space 80 consists of a first spring space 81 and a second spring space 82. The first spring space 81 is formed on the end surface of the rotary member 1 in the axial direction. The second space 82 is formed on the surface of the first plate 22 which faces the first spring space 81. The first spring space 81 has an inner circumferential wall 81 a, an outer circumferential wall 81*b* and a first groove 1*m*. The first groove 1*m* receives a first end portion 27*b* of a helical spring 27. The first groove 1*m* extends in the radial direction of the rotary member 1 and is formed in the outer circumferential wall 81*b* as shown in FIG. 1(*b*). The second spring space 82 has an inner circumferential wall 82*a*, an outer circumferential wall 82*b* and a second groove 22*m*. The second groove 22*m* receives a second end portion 27*c* of the helical spring 27. The second groove 22*m* extends in the radial direction of the first plate 22 and is formed in the outer circumferential wall 82*b* as shown in FIG. 1(*c*).

Figure 2:
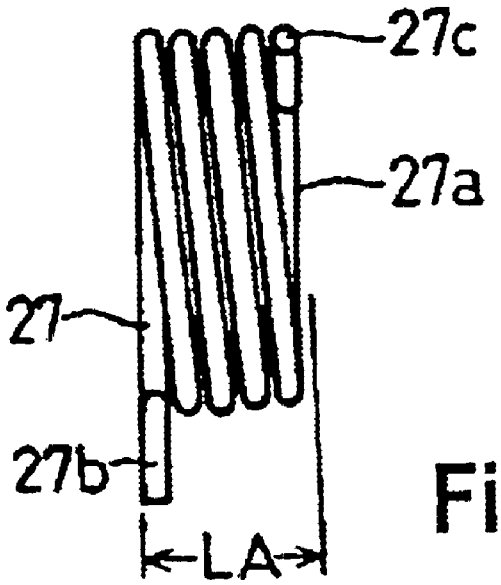
FIG. 2 is a side view of the helical spring used in the valve timing control device shown in FIG. 1(*a*).
Figure 3:
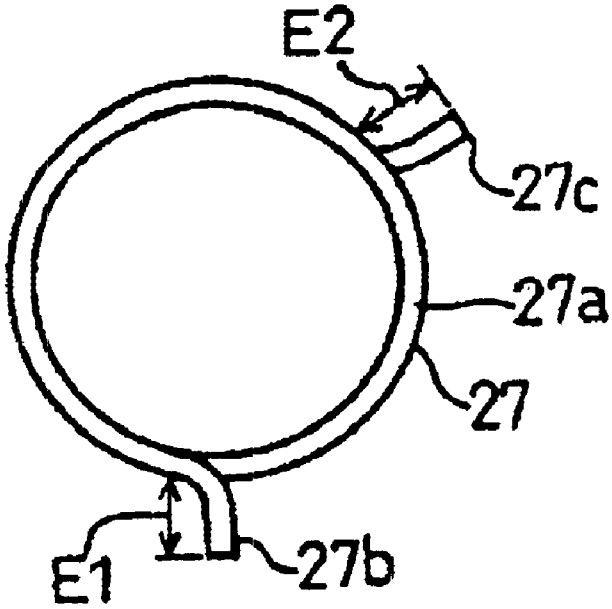
FIG. 3 is an end view of the helical spring shown in FIG. 2.

The helical spring 27 is made of metal and consists of a torsion spring or coil portion 27*a* having the first end portion 27*b* and the second end portion 27*c* as shown in FIGS. 2 and 3. As shown in FIG. 1, the helical spring 27 is arranged in the spring space 80. Specifically, the torsion spring or coil portion 27*a* is arranged in the axial direction of the rotary member 1. As shown in FIG. 3, the end portions 27*b*, 27*c* of the helical spring 27 extend on an imagined radial plane arranged in the radial direction of the coil portion 27*a* and extend in the radial direction of the coil portion 27*a*. As illustrated in FIG. 3, the extended length of the first end portion 27*b* (the distance that the first end portion 27*b* extends outwardly from the outer periphery of the coil portion 27*a*) is designated as E1, and the extended length of the second end portion 27*c* (the distance that the second end portion 27*c* extends outwardly from the outer periphery of the coil portion 27*a*) is designated as E2.

As shown in FIGS. 1(*a*), 1(*b*) and 1(*c*), the first end portion 27*b* of the helical spring 27 is engaged with the rotary member 1 and the second end portion 27*c* of the helical spring 27 is engaged with the first plate 22 of the rotational transmitting member 2. The helical spring 27 urges the rotary member 1 in the advanced direction (i.e., the 'S2" direction in FIGS. 4 and 5) relative to the housing 20. The purpose of the urging force of the helical spring 27 is to offset the above-mentioned force which occurs during the internal combustion engine driving (i.e., the force received by the rotary member and associated with the cams pushing the valves of the internal combustion engine during engine operation).

As shown in FIGS. 1(*a*), 1(*b*) and 1(*c*), the width of the first spring space 81 which is formed between the inner circumferential wall 81*a* and the outer circumferential wall 81*b* is larger than the thickness of the coil portion 27*a*. There are thus plenty of gaps 91 between the torsion spring 27*a* and the walls 81*a*, 81*b* in the first spring space 81. Further, in much the same way, there are plenty of gaps 92 between the coil portion 27*a*, the inner circumferential wall 81*a* and the outer circumferential wall 81*b* in the second spring space 82. When the rotary member 1 rotates in any direction relative to the housing 20 of the rotational transmitting member 2, the coil portion 27*a* is twisted. However, the gaps 91, 92 inhibit or prevent the coil portion 27*a* from touching the circumferential walls 81*a*, 81*b*, 82*a*, 82*b* so as to obtain the expected urging force.

According to the embodiment described above, both end portions 27*b*, 27*c* extend in the radial direction of the torsion spring 27*a* as shown in FIGS. 1(*b*), 1(*c*), 2 and 3. The axial length LA of the helical spring 27 is the same as the length of the coil portion 27*a*. Therefore, the total axial length of the valve timing control device becomes relatively small. In addition, even if the relative rotation between the rotary member 1 and the rotational transmitting member makes the diameter of the coil portion 27*a* small, the engagement portion of the end portions 27*b*, 27*c* are secured. Therefore, the engagement condition of the helical spring 27 between the rotary member 1 and the rotational transmitting member 2 is maintained.

Figure 6:
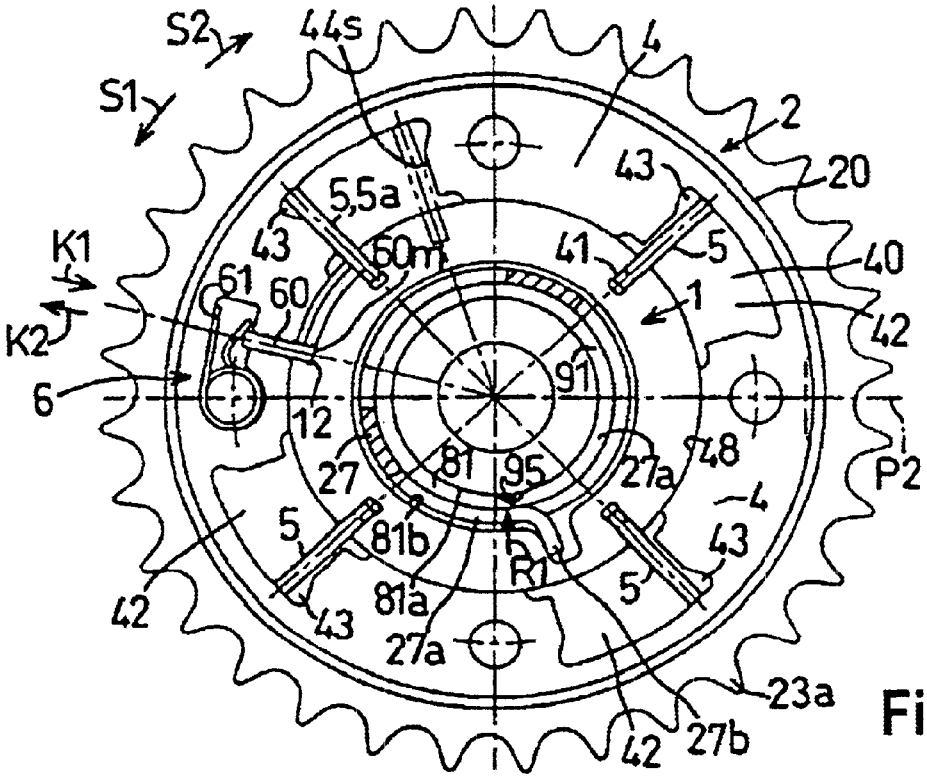
FIG. 6 is a sectional view of a second embodiment of a valve timing control device when the rotary member is in the most delayed or retarded position relative to the rotational transmitting member.
Figure 7:
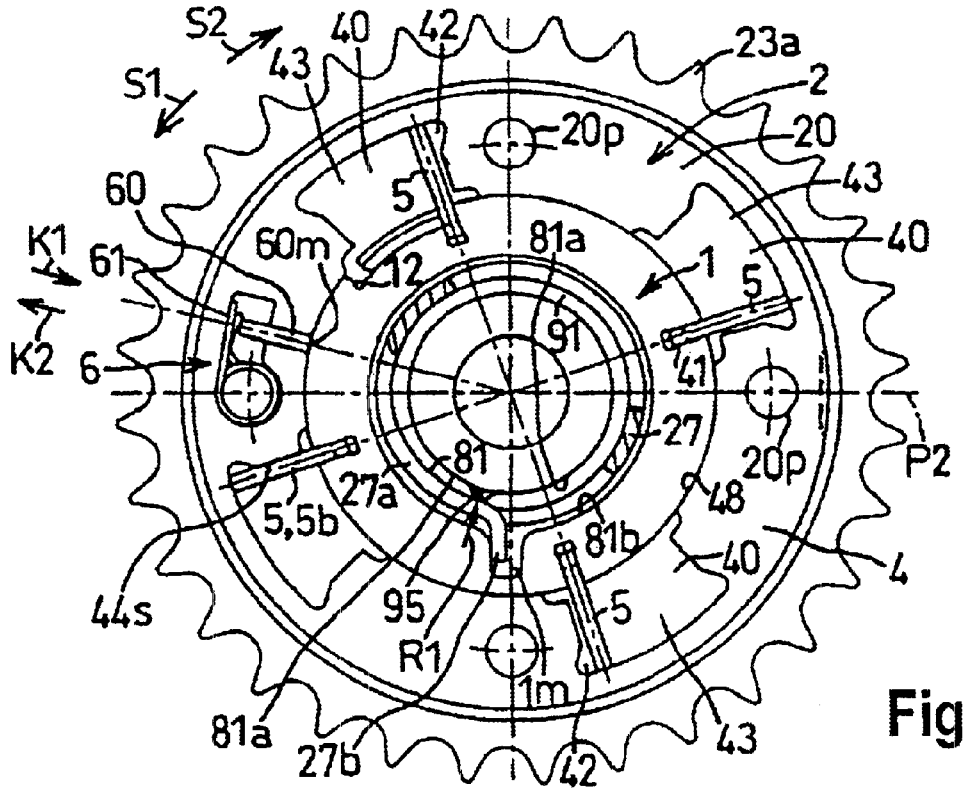
FIG. 7 is a sectional view of the valve timing control device shown in FIG. 6 when the rotary member is in the most advanced position relative to the rotational transmitting member.
Figure 8:
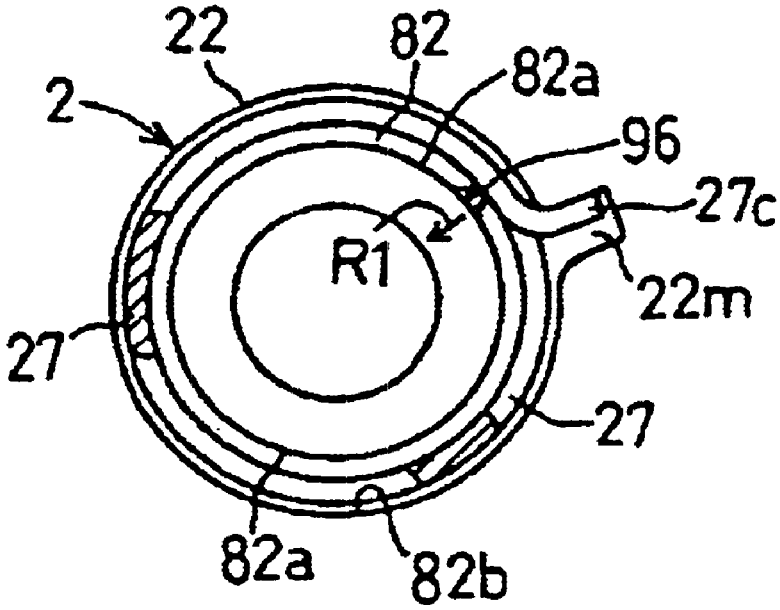
FIG. 8 is an enlarged end view of the second end portion of the helical spring used in the valve timing control device shown in FIG. 6.

FIGS. 6–8 illustrate a second embodiment of the valve timing control device. In this second embodiment, the parts of the valve timing control device that are the same as those in the first embodiment are identified with the same reference numerals as those used in FIGS. 1–5. Having described such features above, a detailed description of such features will not be repeated.

As shown in FIGS. 6 and 7, an enlarged projection 95 is provided on the inner circumferential wall 81*a*. The outwardly directed enlarged projection 95 extends in the axial direction of the rotary member 1. As shown in FIG. 8, another outwardly directed enlarged projection 96 is provided on the inner circumferential wall 82*a*. This enlarged projection 96 extends in the same direction as the enlarged projection 95. The enlarged projections 95, 96 are adapted to engage portions of the coil portion 27*a* adjacent the two end portions 27*b*, 27*c* as shown in FIGS. 6–8. The enlarged projections 95, 96 thus inhibit or prevent the inner surface of the coil portion 27*a* from coming into contact with the inner circumferential walls 81*a*, 82*b*. Here, if the rotary member 1 and the first plate 22 are made of sintering material or casting material, forming the enlarged projections 95, 96 is relatively easy. Even if the relative rotation between the rotary member 1 and the rotational transmitting member 2 causes the diameter of the coil portion 27*a* to become small, the inner surface of the coil portion 27*a* contacts substantially only the enlarged projections 95, 96. Therefore, this second embodiment provides not only the advantages described above in connection with the first embodiment, but also the additional advantage that the frictional resistance between the helical spring 27 and the inner circumferential walls 81*a*, 82*a* do not have to be enlarged.

Figure 9:
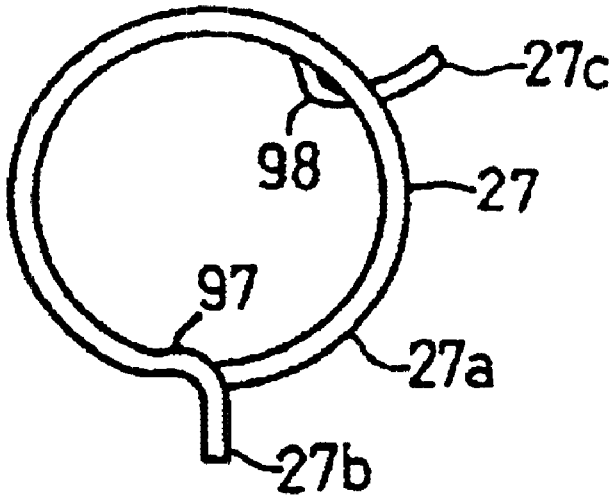
FIG. 9 is an end view of a helical spring used in a third embodiment of the valve timing control device.
Figure 10:
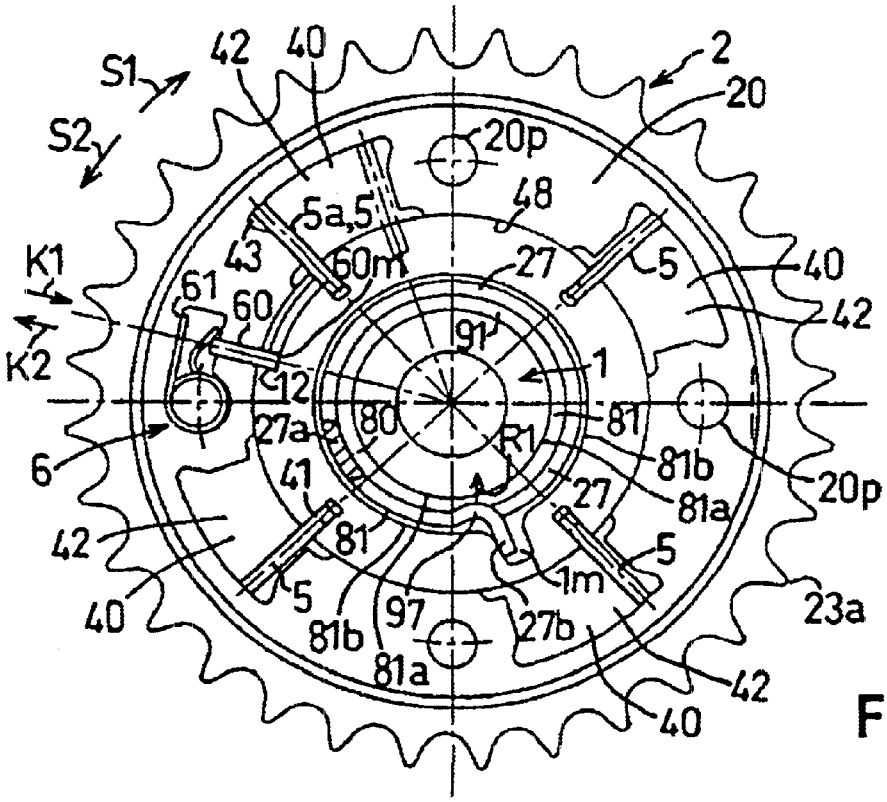
FIG. 10 is a sectional view of the third embodiment of the valve timing control device when the rotary member is in the most delayed or retarded position relative to the rotational transmitting member.
Figure 11:
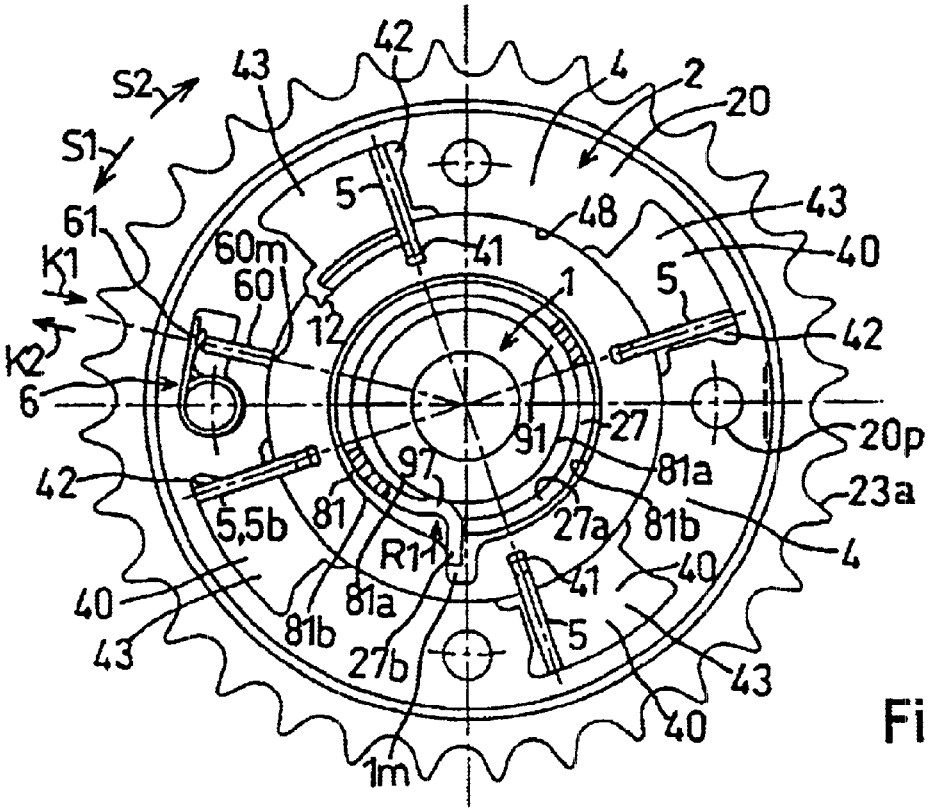
FIG. 11 is a sectional view of the third embodiment of the valve timing control device when the rotary member is in the most advanced position relative to the rotational transmitting member.

FIGS. 9–11 illustrate a third embodiment of the valve timing control device. The parts of the valve timing control device that are the same as those in the first embodiment are identified with the same reference numerals as those used in FIGS. 1–5. Having described such features above, a detailed description of such features will not be repeated.

In this third embodiment, the helical spring 27 has two inwardly directed curved portions 97, 98. The curved portion 97 is arranged at the one end, which is the end wire rod, of the coil portion 27*a*, near the base of the end portion 27*b* (i.e., where the end portion 27*b* meets the coil portion 27*a*). The curve portion 98 is arranged at the other end wire rod of the coil portion 27*a*, near the base of the end portion 27*c* (i.e., where the end portion 27*c* meets the coil portion 27*a*). Even if the relative rotation between the rotary member 1 and the rotational transmitting member 2 causes the diameter of the coil portion 27*a* to become small, the inner surface of the coil portion 27*a* substantially does not contact the inner circumferential walls 81*a*, 82*a*. Rather, only the tops of the curve portions 97, 98 contact the circumferential walls 81*a*, 82*a*. This third embodiment provides advantages similar to those described above in connection with the second embodiment.

Figure 12:
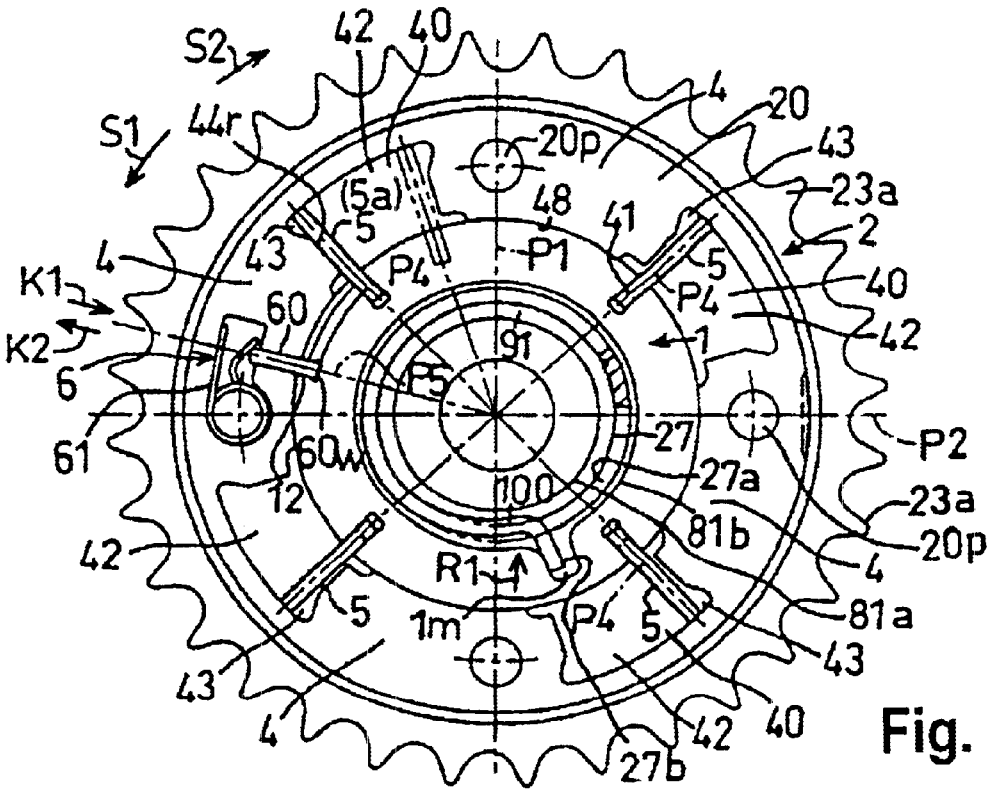
FIG. 12 is a sectional view of a fourth embodiment of a valve timing control device when the rotary member is in the most delayed or retarded position relative to the rotational transmitting member.
Figure 13:
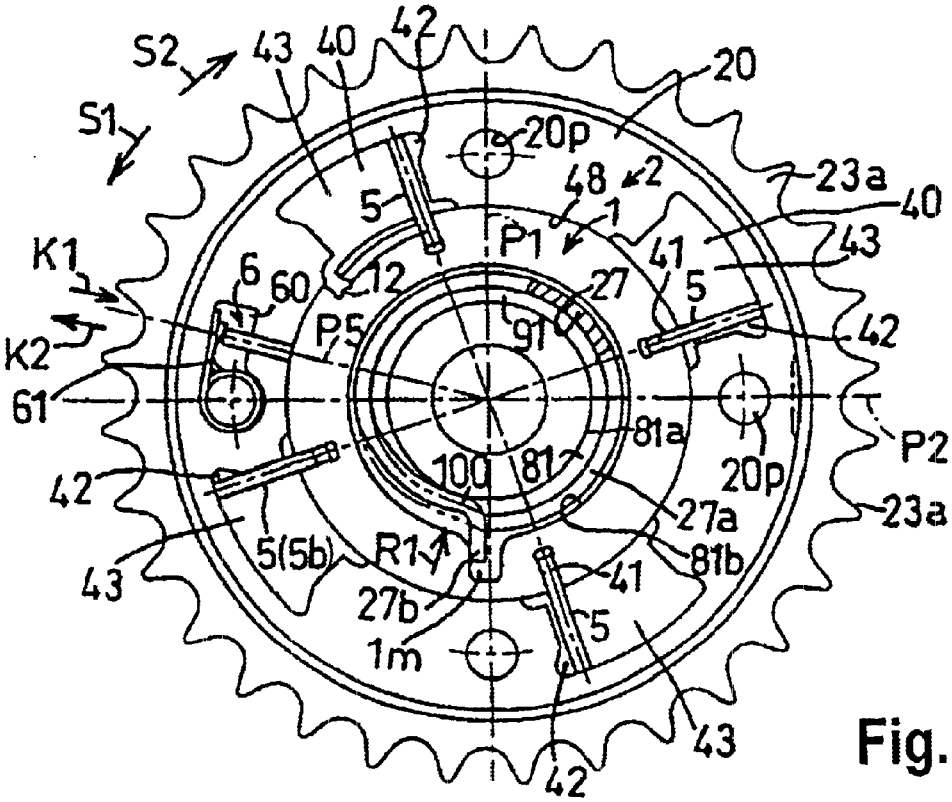
FIG. 13 is a sectional view of the fourth embodiment of the valve timing control device when the rotary member is in the most advanced position relative to the rotational transmitting member.
Figure 14:
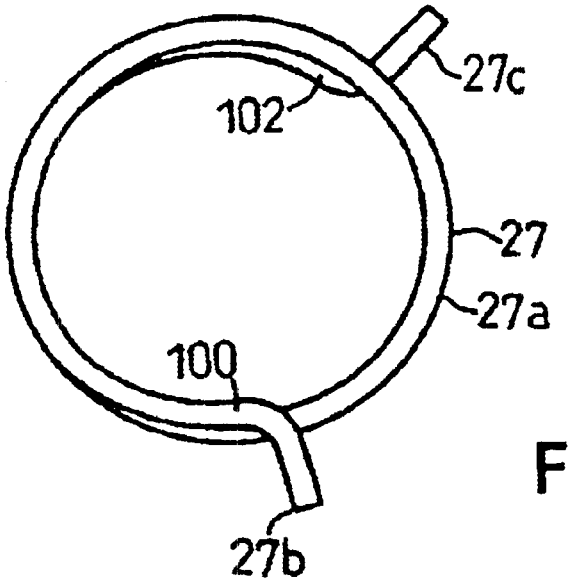
FIG. 14 is an end view of the helical spring used in the valve timing control device shown in FIGS. 12 and 13.
Figure 17A:
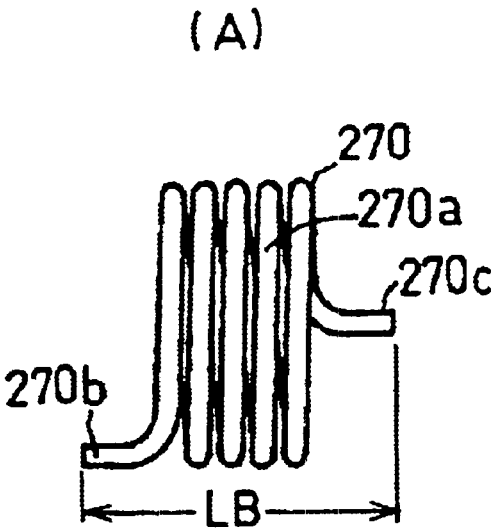
Fig. 17(a) Prior Art
FIG. 17(*a*) is a side view of a known helical spring.
Figure 17B:
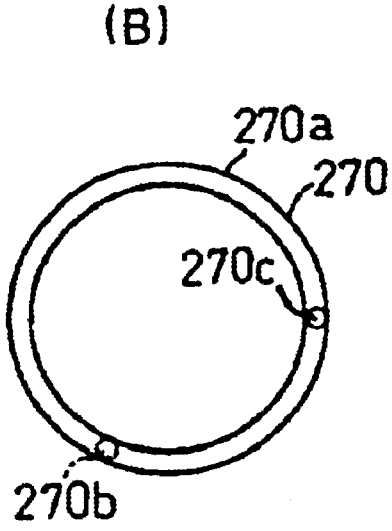
Fig. 17(b) Prior Art

FIGS. 12–14 illustrate a fourth embodiment of the valve timing control device. The parts of the valve timing control device that are the same as those in the first embodiment are identified with the same reference numerals as those used in FIGS. 1–5. Having described such features above, a detailed description of such features will not be repeated.

As shown in FIG. 14, the curvature (radius of curvature) of both end wire rods of the coil portion 27*a* are smaller than the curvature (radius of curvature) of the wire rod forming the other portion (middle portion) of the torsion spring 27*a*. Thus, the coil portion 27*a* of the fourth embodiment has two smaller diameter portions 100, 102. The smaller diameter portion 100 is arranged on one end wire rod of the coil portion 27*a*, near the base of the end portion 27*b* (i.e., where the end portion 27*b* meets the coil portion 27*a*). The other smaller diameter portion 102 is arranged on the other end wire rod of the coil portion 27*a*, near the base of the end portion 27*c* (i.e., where the end portion 27*c* meets the coil portion 27*a*). Even if the relative rotation between the rotary member 1 and the rotational transmitting member 2 causes the diameter of the coil portion 27*a* to become small, the inner surface of the coil portion 27*a* does not contact the inner circumferential walls 81*a*, 82*a*. Rather, only the tops of the small diameter portions 100, 102 contact the walls 81*a* and 82*a*. Therefore, this fourth embodiment provides similar advantages to those associated with the second and third embodiments.

In the above-described embodiments, four pressure chambers 40 and vanes 5 are provided. However, the number of vanes and pressure chambers is not limited in this regard. Also, as described above, the rotational transmitting member 2 is rotated by the crankshaft and the rotary member 1 is attached to the cam shaft 3. However, it is also possible for the rotary member 1 to be rotated by the crankshaft while the housing member 20 of the rotational transmitting member 2 is integrally attached on the cam shaft 3. Further, the vanes 5 can be integrally mounted on the rotary member 1.

Additionally, in the above-described embodiments, the vanes 5 are supported on the rotary member 1. However, it is also possible to support the vanes 5 on the housing 20 of the rotational transmitting member 2.

In the embodiments described above, the locking body 60 provides a lock between the rotary member 1 and the housing 20 when the rotary member 1 rotates relative to the housing 20 and is at the most delayed position. However, it is possible that the locking body 60 provides a lock when the rotary member 1 is positioned at an intermediate portion between the most delayed position and the most advanced position. It is also possible that the locking body 60 provides the lock when the rotary member 1 is at the most advanced position. This type of valve timing control device is normally used for the camshaft 3 for operating exhaust valves.

Regarding the lengths of the first and second end portions 27*b*, 27*c*, end portions 27*b*, 27*c* of the same length are desirable. However, it is also possible for one length to be longer than the other one. Of course, it is also acceptable that only one end portion 27*b*, 27*c* extends on the radial surface of the coil portion 27*a*. In this case, it is preferred that the second end portion 27*c* extend on the radial surface of the coil portion 27*a* because the total axial length of the valve timing control device can be made relatively small.

In addition, in the embodiments described above, the end portions 27*b*, 27*c* extend in the radial direction of the coil portion 27*a*. However, the precise angle of the end portions 27*b*, 27*c* is not important, but both of the end portions 27*b*, 27*c* are on the same surface, which is the axial direction of the coil portion 27*a*. Thus, it is possible that the angle between the end portions 27*b*, 27*c* and the end of the torsion spring is not a right angle. It is also possible for the end portion 27*b* and/or 27*c* to be extended in the inner direction of the torsion spring 27*a*.

Figure 15:
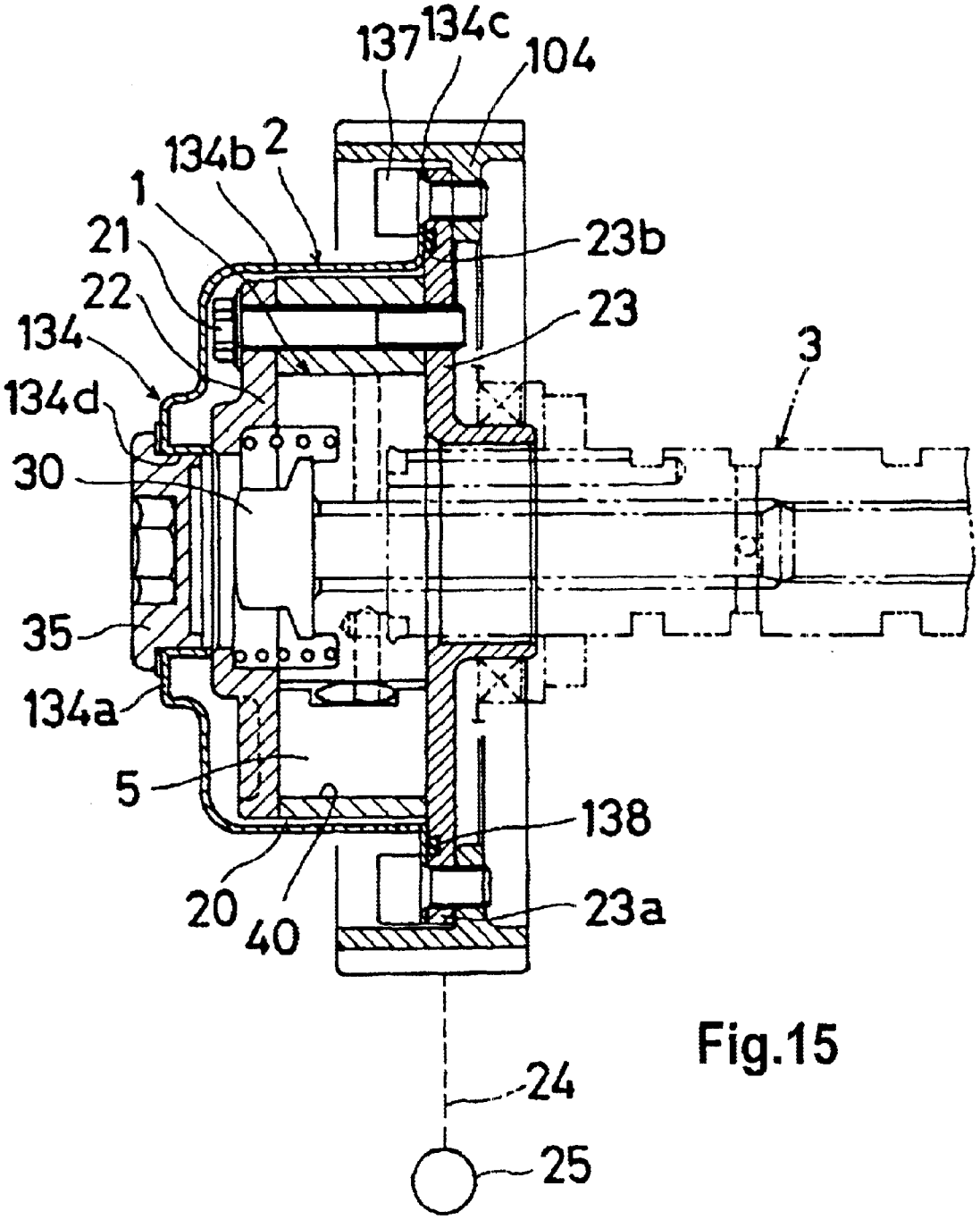
FIG. 15 is a vertical cross-sectional view of a fifth embodiment of a valve timing control device in accordance with the prevent invention.

FIG. 15 illustrates a fifth embodiment of the valve timing control device. The parts of the valve timing control device that are the same as those in the first embodiment are identified with the same reference numerals as those used in FIGS. 1–5. Having described such features above, a detailed description of such features will not be repeated.

As shown in FIG. 15, a pulley 104 connected with the gear 25 of the crankshaft via the transmitting means 24 is fixed on the second plate 23 of the rotational transmitting member 2 by way of bolts 137. The bolts 137 are bored through or positioned at the outer end portion 23*a* of the second plate 23.

A front cover 134 is made from a sheet of pressed iron plate. The front cover 134 has a bottom or end wall 134*a*, a circumferential wall 134*b* and an outer circumferential portion 134*c*. The bottom wall 134 faces the first plate 22, the circumferential wall 134*b* faces the housing 20 and the outer circumferential portion 134*c* faces the outer end portion 23*a* of the second plate 23. The outer circumferential portion 134*c*, the outer end portion 23*a* and the pulley 104 are integrally fixed by the bolts 137.

The surface of the outer end portion 23*a* of the second plate 23 which faces the outer circumferential portion 134*c* is provided with a U-shaped groove 23*b*. The groove 23*b* is a circular groove extending around the housing 20. A seal ring 138 is positioned in the groove 23*b* to prevent oil from leaking.

The bottom or end wall 134*a* of the front cover 134 has a hole or through opening 134*d* for screwing or tightening the bolt 30. The hole 134*d* is closed liquidly (in a liquid-tight manner) by a lid 35. Thus, the front cover 134 covers the rotational transmitting member 2 for protecting the transmitting means 24, for example the timing belt, against the pressure fluid. In addition, it is not necessary to secure any space for inserting the seal ring 138. Therefore, the axial length of the rotational transmitting member 2 is relatively small.

Figure 16:
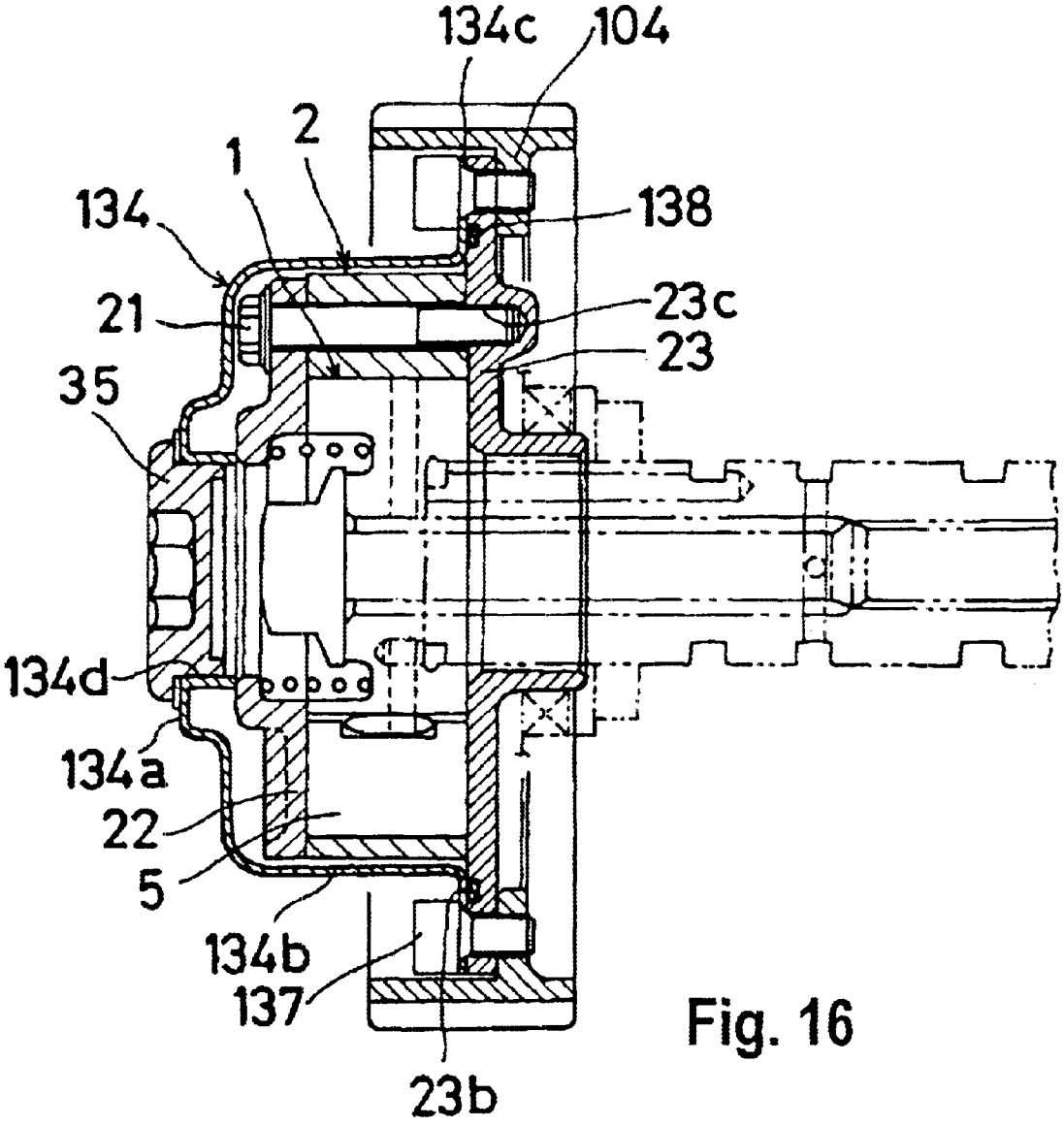
FIG. 16 is a vertical cross-sectional view of a sixth embodiment of a valve timing control device in accordance with the prevent invention.

FIG. 16 illustrates a sixth embodiment of the valve timing control device according to the present invention. The parts of the valve timing control device that are the same as those in the first embodiment are identified with the same reference numerals as those used in FIGS. 1–5. Having described such features above, a detailed description of such features will not be repeated.

As shown in FIG. 16, a bolt receiving bore of the second plate 23 is a bottomed bore or blind bore 23*c*. Thus, the sealing characteristic around the fixing bolt 21 are improved.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing control device comprising:

a rotary member adapted to be rotatably arranged in a torque transmitting route between a crankshaft of an internal combustion engine and a camshaft of the internal combustion engine;

a rotational transmitting member rotatable relative to the rotary member;

a pressure chamber formed by the rotary member and the rotational transmitting member;

a vane provided on the rotary member or the rotational transmitting member dividing the pressure chamber into an advancing chamber and a delaying chamber;

a helical spring which urges the rotary member in the advancing direction to expand the advancing chamber, the helical spring having a coil portion, a first end portion engaging the rotary member and a second end portion engaging the rotational transmitting member; and at least one of the first and second end portions of the helical spring extending on an imagined radial plane arranged in a radial direction of the coil portion.

2. The valve timing control device according to claim 1, wherein the at least one of the first and second end portions of the helical spring extends in the radial direction of the coil portion.

3. The valve timing control device according to claim 2, wherein the at least one of the first and second end portions of the helical spring extends outwardly from the coil portion.

4. The valve timing control device according to claim 3, wherein both the first and second end portions of the helical spring extend in the radial direction of the coil portion.

5. The valve timing control device according to claim 1, wherein both the first and second end portions of the helical spring extend in the radial direction of the coil portion.

6. The valve timing control device according to claim 1, wherein both the first and second end portions of the helical spring extend outwardly in the radial direction of the coil portion.

7. The valve timing control device according to claim 1, wherein the helical spring is positioned in a spring space surrounded by an inner circumferential wall and an outer circumferential wall, and including at least one axially extending and outwardly directed projection formed on the inner circumferential wall to engage a portion of the coil portion adjacent one of the first and second end portions.

8. The valve timing control device according to claim 1, wherein the helical spring is positioned in a spring space surrounded by an inner circumferential wall and an outer circumferential wall, and including a pair of axially extending and outwardly directed projections formed on the inner circumferential wall to engage a portion of the coil portion adjacent each of the first and second end portions.

9. The valve timing control device according to claim 1, wherein the coil portion of the helical spring is provided with an inwardly directed curved portion at a position where the coil portion meets one of the first and second end portions.

10. The valve timing control device according to claim 1, wherein the coil portion of the helical spring is provided with a pair of inwardly directed curved portions each located at a position where the coil portion meets one of the first and second end portions.

11. The valve timing control device according to claim 1, wherein an end of the coil portion which meets with one of the first and second end portions of the helical spring possesses a smaller diameter than a remaining part of the coil portion.

12. The valve timing control device according to claim 1, wherein ends of the coil portion which meet with the first and second end portions of the helical spring possess a smaller diameter than a remaining part of the coil portion.

13. A valve timing control device comprising:

a rotary member adapted to be rotatably arranged in a torque transmitting route between a crankshaft of an internal combustion engine and a camshaft of the internal combustion engine;

a first annular spring space formed in the rotary member, the first annular spring space having an annular inner circumferential wall and an annular outer circumferential wall;

a rotational transmitting member rotatable relative to the rotary member;

a second annular spring space formed in the rotational transmitting member, the second annular spring space having an annular inner circumferential wall and an annular outer circumferential wall;

a pressure chamber formed by the rotary member and the rotational transmitting member;

a vane provided on the rotary member or the rotational transmitting member dividing the pressure chamber into an advancing chamber and a delaying chamber;

a helical spring positioned in the first and second annular spring spaces to urge the rotary member in the advancing direction to expand the advancing chamber, the helical spring having a coil portion, a first end portion and a second end portion;

the first end portion of the helical spring engaging a first groove formed in one of the inner circumferential wall of the rotary member and the outer circumferential wall of the rotary member; and the second end portion of the helical spring engaging a second groove formed in one of the inner circumferential wall of the rotational transmitting member and the outer circumferential wall of the rotational transmitting member.

14. The valve timing control device according to claim 13, wherein both of the first and second end portions of the helical spring extend in the radial outward direction of the coil portion.

15. The valve timing control device according to claim 13, wherein at least one of the first and second end portions of the helical spring extends outwardly from the coil portion.

16. The valve timing control device according to claim 13, wherein the first groove is formed in the outer circumferential wall of the rotary member and the second groove is formed in the outer circumferential wall of the rotational transmitting member.

17. The valve timing control device according to claim 13, including an axially extending and outwardly directed projection formed on the inner circumferential wall of the rotary member to engage a portion of the coil portion adjacent the first end portion, and an axially extending and outwardly directed projection formed on the inner circumferential wall of the rotational transmitting member to engage a portion of the coil portion adjacent the second end portion.

18. The valve timing control device according to claim 13, wherein the coil portion of the helical spring is provided with a pair of inwardly directed curved portions each located at a position where the coil portion meets one of the first and second end portions.

19. The valve timing control device according to claim 13, wherein ends of the coil portion which meet with the first and second end portions of the helical spring possess a smaller diameter than a remaining part of the coil portion.

* * * * *